United States Patent [19]

Smith

[11] Patent Number: 4,702,243

[45] Date of Patent: Oct. 27, 1987

[54] EMERGENCY AIR SUPPLY APPARATUS

[76] Inventor: Ronald D. Smith, Appleton City, Mo. 64724

[21] Appl. No.: 899,066

[22] Filed: Aug. 21, 1986

Related U.S. Application Data

[63] Continuation-in-part of Ser. No. 775,535, Sep. 13, 1985, abandoned, which is a continuation of Ser. No. 531,960, Sep. 14, 1983, abandoned.

[51] Int. Cl.[4] ..... A62B 7/00

[52] U.S. Cl. ..... 128/205.24; 128/204.18; 128/205.25

[58] Field of Search ..... 128/205.25, 205.24, 128/201.25, 201.28, 202.27, 205.21, 205.22, 206.12, 206.15, 206.17, 206.21, 206.28, 207.12, 912, 204.18; 137/68.1

[56] References Cited

U.S. PATENT DOCUMENTS

| | | | |
|---|---|---|---|
| 902,961 | 11/1908 | Goodnow | 128/207.12 |
| 1,118,649 | 11/1914 | Halter | 137/68.1 |
| 2,087,119 | 7/1937 | Ronenow et al. | 128/205.25 |
| 2,914,067 | 11/1959 | Meidenbauer, Jr. | 128/205.23 |
| 3,045,671 | 7/1962 | Updegraff | 128/205.24 |
| 3,238,940 | 3/1966 | Kopas | 128/205.25 |
| 3,976,067 | 8/1976 | Amlong | 128/205.24 |
| 4,022,202 | 5/1977 | Price | 128/205.24 |
| 4,119,097 | 10/1978 | Spector | 128/205.25 |
| 4,573,463 | 3/1986 | Hall | 128/205.25 |
| 4,582,054 | 4/1986 | Ferrer | 128/205.25 |

FOREIGN PATENT DOCUMENTS

| | | | |
|---|---|---|---|
| 1491660 | 8/1969 | Fed. Rep. of Germany | 128/205.25 |
| 1378213 | 10/1964 | France | 128/205.25 |

OTHER PUBLICATIONS

*Mada Medical Products,* Inc., "Life Support Oxygen System", Brochure, Oct. 11, 1972.

*Primary Examiner*—William E. Kamm
*Assistant Examiner*—J. P. Lacyk
*Attorney, Agent, or Firm*—Kokjer, Kircher, Bradley, Wharton, Bowman & Johnson

[57] ABSTRACT

A full face smoke mask having a detachable air tank for dispensing air to the mask in smoke emergencies. A valve on the air tank is opened automatically when the tank is threaded to a rigid fitting carried on the mask. The valve body is equipped with a rupture film which ruptures to vent excessive pressure in the dispensing system.

10 Claims, 4 Drawing Figures

EMERGENCY AIR SUPPLY APPARATUS

BACKGROUND AND SUMMARY OF THE INVENTION

This application is a continuation in part of my prior application, Ser. No. 775,535, filed on Sept. 13, 1985, and now abandoned, which is a continuation of application Ser. No. 531,960 filed on Sept. 14, 1983 and now abandoned.

This invention relates to a face mask and an accompanying air tank used to supply emergency air in the event of a fire.

The smoke and toxic fumes that are generated by fires are the cause of many fire related deaths, especially in homes and in hotels and other high rise buildings. At present, emergency air supplies are not commonly available in such buildings. In order to be practical, a device for supplying emergency air must be portable and must be capable of being applied to the face and actuated before the user is overcome by smoke or fumes. The mask must also be capable of sealing effectively against the face and maintaining the seal while the user escapes or undertakes rescue activities. The device should also be self supporting in order to leave both hands free to engage in escape activities, the carrying of valuables, and helping others to escape the fire.

It is an important object of the present invention to provide an emergency breathing device which includes a face mask and a portable air tank that can be quickly and easily attached and activated to dispense air during a fire emergency. It is a particularly important feature of the invention that attachment of the air cylinder to the mask automatically opens the cylinder in order to dispense air, thus requiring only a single operation to attach the air cylinder and activate it.

Another object of the invention is to provide an emergency breathing device in which the flow of air is easily adjustable. The unique valve construction allows the air flow to be controlled by turning of the air cylinder, and this simple method of air control is particularly advantageous in emergency situations.

A further object of the invention is to provide a device of the character described in which the mask fully covers the face and effectively seals out smoke and fumes without obstructing vision. The foam strip which seals the mask to the face is effective in sealing out smoke and accommodates faces of virtually all sizes and shapes without requiring extensive adjustment.

An additional object of the invention is to provide a device of the character described which allows the user to make use of both hands for rescue operations and other activity.

Yet another object of the invention is to provide a device of the character described which is constructed to automatically vent excessive pressure in the air dispensing system.

A still further object of the invention is to provide a device of the character described which is constructed of materials and components that are able to withstand the high temperatures encountered in fire conditions.

Still another object of the invention is to provide a device of the character described which can be conveniently stored when not in use.

A further object of the invention is to provide a device of the character described in which the air cylinder is suspended from the face mask at a location to avoid interfering with escape attempts and other physical activities engaged in by the user.

Other and further objects of the invention, together with the features of novelty appurtenant thereto, will appear in the course of the following description:

DETAILED DESCRIPTION OF THE INVENTION

In the accompanying drawing which forms a part of the specification and is to be read in conjunction therewith and in which like reference numerals are used to indicate like parts in the various views.

Figures 1, 2, 3, 4:
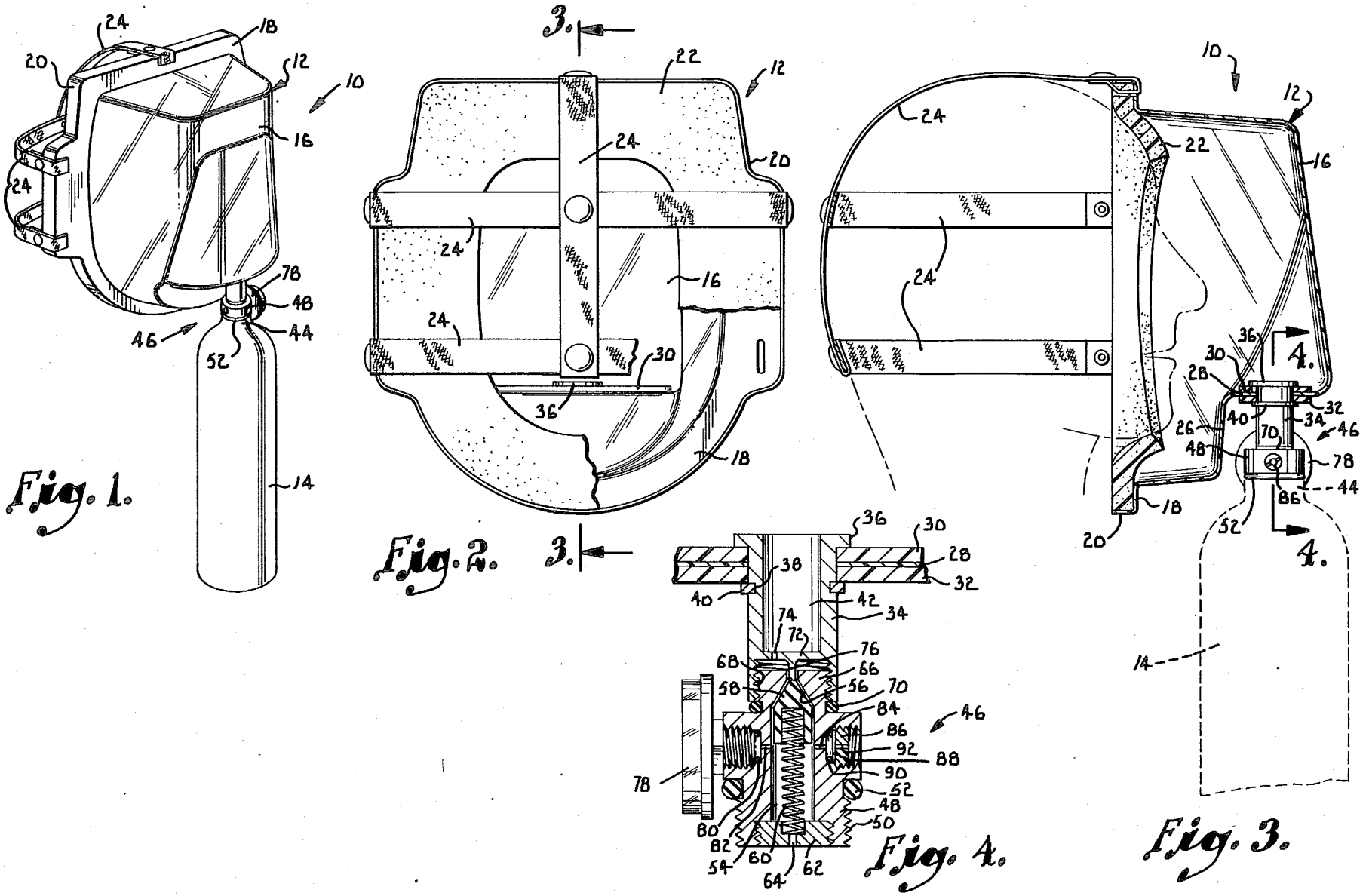
FIG. 1 is a perspective view of an emergency breathing device constructed according to a preferred embodiment of the present invention, with the air tank attached to the face mask.
FIG. 2 is a rear elevational view of the face mask on an enlarged scale, with portions broken away for purposes of illustration.
FIG. 3 is a sectional view taken generally along line 3—3 of FIG. 2 in the direction of the arrows, with the air tank and the head and face of a user shown in broken lines.
FIG. 4 is a fragmentary sectional view on an enlarged scale taken generally along line 4—4 of FIG. 3 in the direction of the arrows.

Referring now to the drawing in more detail, numeral 10 generally designates an emergency breathing device constructed in accordance with the present invention. The main components of the breathing device 10 are a face mask 12 and a portable tank 14 containing compressed air. The face mask 12 includes a transparent face shield 16 which is large enough to cover the eyes, nose and mouth of a person wearing the mask, as best shown in FIG. 3. Preferably, the face shield 16 is formed from a high temperature plastic material which is transparent in order to avoid obstructing the vision of the wearer. Vacuum molded polyvinyl chloride having a flash point of 400° F. is the preferred material.

The face shield 16 projects forwardly from a rim 18 which extends around the face shield and is preferably formed integrally therewith. A peripheral flange 20 extends rearwardly from the outer edge of the rim 18. A continuous foam strip 22 is glued or otherwise secured to the inside surfaces of rim 18 and flange 20, with the strip 22 projecting inwardly beyond the rim, as shown in FIG. 3. The foam strip 22 comprises a foam material that is capable of compressing and flexing to conform with the contour of the face, and it is also able to withstand the high temperatures encountered during fire conditions. Preferably, the strip 22 is constructed of a closed cell polyester foam having a temperature rating of 400° F. or better.

The mask 12 is held in place on the face by a plurality of elastic straps 24. Two of the straps 24 are generally horizontal and are connected at their opposite ends with the rim 18 of the mask. The third strap is connected with the top portion of rim 18 and also with the mid points of the two horizontal straps. The elasticity of the straps 24 pulls the mask firmly against the face of the wearer and maintains the foam strip 22 snugly against the face in order to provide a continuous seal for the interior region of the face shield 16.

The bottom portion of the face shield 16 has a special configuration which is best shown in FIG. 3. Below the chin area of the wearer, the shield extends outwardly and then upwardly to form a generally vertical wall 26. A horizontal ledge or shoulder 28 extends outwardly from the upper edge of wall 26 and connects with the bottom of the main outer wall of shield 16. With reference additionally to FIG. 4, shoulder 28 is reinforced by a pair of plastic reinforcing plates 30 and 32 which are suitably secured to the top and bottom surfaces of shoulder 28, respectively. Shoulder 28 is sandwiched between the two plates 30 and 32, and the reinforcing plates are preferably somewhat thicker than the shoulder in order to strengthen it for carrying of the tank 14.

A cylindrical fitting is secured to the shoulder 28 of the mask. An enlarged flange 36 on the top end of fitting 34 rests on top of the upper reinforcing plate 30, and the main body of fitting 34 extends through shoulder 28 and the two reinforcing plates 30 and 32. Immediately below the lower reinforcing plate 32, the body of fitting 34 is provided with an annular groove 38 into which a retaining ring 40 is snapped. The retaining ring 40 secures the connection of fitting 34 to shoulder 28 and prevents the fitting from moving relative to the mask. Fitting 34 has a central bore 42 which communicates with the inside of the face shield 16 in order to supply air thereto from the tank 14.

Tank 14 is a generally cylindrical cannister having a reduced neck 44 on its top end which provides an outlet for discharge of the compressed air which is contained within the tank. A valve which is generally designated by numeral 46 is mounted on the neck 44 and acts to control the dispensing of air from the tank. With reference to FIG. 4 in particular, the valve 46 has a valve body 48 formed from aluminum or another suitable material. The lower end of the valve body 48 is threaded at 50 to permit the valve body to be threaded into the neck 44 of tank 14. An O-ring 52 fitted on the valve body provides an airtight seal between the valve body and air tank.

An air passage 54 extends longitudinally through valve body 48 in order to accommodate air flow from the air tank to the fitting 34. At its top end, the flow passage 54 is tapered to provide a tapered valve seat 56. Flow through passage 54 is controlled by a valve element in the form of a plug 58 having a tapered nose presenting a size and configuration to seat firmly against the tapered valve seat 56. A compression spring 60 continuously urges plug 58 toward a seated position against the valve seat in which air flow through passage 54 is blocked. The top end of spring 60 is seated in a recess in plug 58, and the bottom end of the spring engages a retainer 62 which is threaded into the bottom end of the valve body 48. Retainer 62 has a small air passage 64 which provides communication between the interior of the air tank 14 and the flow passage 54.

The face mask 12 and air tank 14 are detachable and are normally connected by a threaded connection between the valve body 48 and fitting 34. The valve body has an externally threaded top end portion 66 which may be threaded into the bottom end of fitting 34. The bottom portion of the fitting is internally threaded at 68 in order to mate with the external threads on portion 66. An O-ring 70 is fitted on the valve body 48 in order to provide a seal between the valve body and fitting 34 when the threaded connection is established.

Above threads 68, a partition 72 is formed inside of fitting 34. A small air passage 74 is formed through partition 72 in order to accommodate air flow through the fitting. A finger 76 projects downwardly from the center of partition 72. When valve body 48 is fully threaded into fitting 34, finger 76 contacts the nose of the valve plug 58 and thereby pushes plug 58 downwardly to displace it from the valve seat 56. Air is then able to flow between plug 58 and seat 56 and is able to pass the valve seat and flow into the fitting 34.

One side of valve body 48 is equipped with a pressure guage 78 which provides a visual reading of the air pressure in tank 14. The guage 78 is threaded into the side of body 48 to compress an O-ring 80 which provides a seal between the guage and valve body. A small air passage 82 transmits the pressure in bore 54 to the pressure guage.

The side of the valve body opposite guage 78 is provided with a vent passage 84 which extends from bore 54 in order to vent excessive pressure. A retainer plug 86 is threaded into valve body 48 and acts to press a thin rupture film 88 against an O-ring 90. An air passage 92 extends through the center of the retainer plug 86. The film 88 normally blocks flow between passages 84 and 92. However, the pressure in bore 54 is applied to the rupture film 88 and causes the film to rupture when the pressure is excessive. Then, passages 84 and 92 are in communication and act to vent the excessive pressure to the atmosphere. Preferably, the rupture film 88 is a food grade film which ruptures when subjected to pressures of 600 psi or greater.

In use, the smoke mask 12 may be applied to the face in the event of a fire. As shown in FIG. 3, shield 16 fully covers the face, including the eyes, nose and mouth. The foam strip 22 provides a continuous seal against the face in order to seal out smoke and toxic fumes generated by the fire. The flexibility and compressibility of the seal strip 22 allows it to conform to the facial contour while maintaining a good seal.

The air cylinder 14 is attached to the mask and activated by threading portion 66 into the internal threads 68 on the bottom end of fitting 34. When the valve body is fully threaded into the fitting in the position shown in FIG. 4, O-ring 70 provides a seal between the valve body and fitting, and finger 76 displaces the valve plug 58 from the valve seat 56. Then, the compressed air within tank 14 is able to flow around the valve plug and through passage 74 and bore 42 into the interior of the smoke mask. The tank 14 is able to supply sufficient air for 10–12 minutes, and this is normally sufficient to permit escape from the fire. In addition, sufficient time is provided to allow valuables to be carried away and to permit rescue operations to be undertaken. The tank 14 is suspended from fitting 34, and this frees both hands of the wearer for other activity. It is also important to note that the tank 14 is suspended well away from the body in order to avoid interfering with normal physical activities.

When not is use, the breathing device 10 can be conveniently stored. Mask 12 can be hung on a suitable wall bracket (not shown), and tank 14 can be suspended from the mask by threading the valve body 48 partially into fitting 34. If portion 66 of the valve body is threaded only several turns into fitting 34, finger 76 does not displace plug 58 from the valve seat 56. However, the finger 76 is close enough to plug 58 that only a single revolution or part of a revolution of tank 14 is sufficient to open the valve plug 58. Consequently, the air dispensing system can be quickly and easily activated to begin dispensing air to the smoke mask in the event of a fire. It should also be noted that as portion 66 is progressively threaded into fitting 34, valve plug 58 is progressively opened to a greater extent. Consequently, the rate of air flow into the mask can be regulated by additional threading of the valve body into or out of fitting 34. In addition, intermittent flow of air into the mask can be achieved by intermittently backing the valve body out of the fitting in order to cut off the air flow and then threading the valve body back into the fitting to again open the flow passage.

The pressure guage 78 provides a visual indication of the air pressure within tank 14, and thus indicates when the tank contains insufficient air and required replacement. When a tank has been spent, it can be disposed of and replaced with an additional tank. If the air pressure builds up excessively, the rupture film 88 ruptures and thereby vents the excessive pressure to the atmosphere. It is also noteworthy that the compressed air creates a pressurized environment within the mask and dispensing system in order to prevent the infiltration of smoke or toxic fumes.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. Emergency breathing apparatus comprising:

a face mask adapted for application to the face, said mask having a substantially flat shoulder oriented generally horizontally when the mask is applied to the face;

plate means for reinforcing said shoulder;

strap means for holding said mask on the face;

a rigid fitting having a flow path therein, said fitting having a flange on one end engaging said plate means inside of the mask and said fitting having an exterior groove adjacent said plate means outside of the mask;

a snap ring received in said groove to connect the fitting rigidly with the mask with said flow path of the fitting communicating with the interior of the mask and with the shoulder and plate means disposed between said flange and snap ring;

a portable container holding a quantity of compressed gas suitable for breathing;

a threaded connection between said container and fitting permitting said container to be applied to the fitting and threaded thereto for attachment of the container to the fitting in suspension therefrom; and valve means for controlling the discharge of gas from said container, said valve means normally closing the container to confine the gas therein and said valve means opening the container to permit discharge of the gas therefrom and through said flow path in response to threading of the container to the fitting.

2. Apparatus as set forth in claim 1, wherein said mask is a rigid transparent mask adapted to cover the eyes, nose and mouth when applied to the face.

3. Apparatus as set forth in claim 2, including a foam strip on the mask effecting a seal with the face to prevent smoke from entering the mask.

4. Apparatus as set forth in claim 1, wherein said valve means comprises;

a valve body on said container presenting a flow passage for receiving the gas in the container, said threaded connection being between said valve body and fitting and providing communication between the flow passage and flow path;

a valve seat in said passage;

a valve element in said passage having a seated position on said valve seat wherein the passage is blocked and an unseated position wherein the passage is open to flow;

spring means for urging said valve element toward the seated position; and means for displacing said valve element from the seated position in response to threading of said valve body to said fitting.

5. Apparatus as set forth in claim 4, wherein said displacing means comprises a projection on said fitting located to unseat said valve element from the valve seat when the valve body is threaded to the fitting.

6. Apparatus as set forth in claim 4, including:

a vent passage in said valve body for venting pressure in said flow passage; and a rupture film normally blocking said vent passage, said film rupturing when exposed to pressure above a predetermined level to thereby vent pressure above said level from the flow passage.

7. Emergency breathing apparatus comprising:

a rigid face mask for application to the face;

releaseable means for securing said mask on the face;

a rigid fitting secured rigidly to said mask, said fitting having a flow path therethrough communicating with the interior of the mask;

a portable container holding compressed air;

a valve body on said container presenting a flow passage therethrough, said flow passage providing communication between the inside of the container and said flow path;

a tapered valve seat in said valve body disposed in the flow passage;

a valve element in said flow passage movable therein away from and toward said valve seat between open and closed positions respectively, said valve element having a tapered configuration complemental to the valve seat and said valve element seating against the valve seat to block flow through said flow passage in the closed position, said valve element being unseated from the valve seat in the open position to allow flow through the flow passage;

yieldable means for urging said valve element toward the closed position;

a threaded connection between said valve body and fitting permitting the valve body to be threaded to said fitting to suspend the container from the mask; and a rigid projection on said fitting at a location to act against said valve element in a manner to displace said valve element from the valve seat from the closed position to the open position when the valve body is threaded to the fitting, whereby air is made available to the mask automatically when the valve body is threaded to the fitting.

8. Apparatus as set forth in claim 7, including:

a vent passage in said valve body providing communication between said flow passage and the atmosphere when open; and a rupture element in said vent passage normally closing same, said rupture element rupturing when exposed to pressure in excess of a predetermined level.

9. Emergency breathing apparatus comprising:

a rigid face mask applicable to the face to cover the eyes, nose and mouth, said mask being transparent and including a substantially horizontal shoulder spaced away from the face;

strap means for holding the face mask on the face;

a foam strip on said mask at a location to effect a continuous seal against the face to prevent smoke from entering the mask;

a rigid fitting presenting a flow path therethrough;

means for rigidly securing said fitting to said shoulder with said flow path in communication with the interior of the mask;

a portable container holding compressed air;

a valve on said container for controlling the discharge of air therefrom, said valve including a valve body having a substantially straight flow passage therethrough and a valve element movable in said flow passage to open and close same for controlling air flow therethrough;

a threaded connection between said valve and fitting permitting the container to be attached to the fitting in suspension therefrom;

means for moving said valve element automatically to the open position when the valve is threaded to the fitting;

a vent passage in said valve body providing communication between said flow passage and the atmosphere when open, said vent passage extending substantially perpendicular to said flow passage; and a rupture element in said vent passage normally closing same, said rupture element rupturing when exposed to pressure in excess of a predetermined level to thereby vent excess pressure from the flow passage.

10. Apparatus as set forth in claim 9, including a pair of reinforcing plates sandwiching said shoulder therebetween and acting to reinforce the connection between said fitting and shoulder.

* * * * *